US010313807B2

(12) United States Patent
Henriksen et al.

(10) Patent No.: US 10,313,807 B2
(45) **Date of Patent: *Jun. 4, 2019**

(54) HEARING DEVICE INCLUDING ANTENNA UNIT

(71) Applicant: Oticon A/S, Smørum (DK)

(72) Inventors: Poul Henriksen, Smørum (DK); Jens Troelsen, Smørum (DK)

(73) Assignee: OTICON A/S, Smørum (DK)

( * ) Notice: Subject to any disclaimer, the term of this patent is extended or adjusted under 35 U.S.C. 154(b) by 0 days.

This patent is subject to a terminal disclaimer.

(21) Appl. No.: 15/947,652

(22) Filed: Apr. 6, 2018

(65) Prior Publication Data

US 2018/0227683 A1 Aug. 9, 2018

Related U.S. Application Data

(63) Continuation of application No. 15/191,135, filed on Jun. 23, 2016, now Pat. No. 9,973,864.

(30) Foreign Application Priority Data

Jun. 24, 2015 (EP) ..... 15173561

(51) Int. Cl.
*H04R 25/00* (2006.01)
*H01Q 1/27* (2006.01)
*H01Q 1/44* (2006.01)

(52) U.S. Cl.
CPC ..... *H04R 25/554* (2013.01); *H01Q 1/273* (2013.01); *H04R 25/602* (2013.01); *H04R 25/65* (2013.01);

(Continued)

(58) Field of Classification Search
CPC ..... H04R 2225/51
See application file for complete search history.

(56) References Cited

U.S. PATENT DOCUMENTS 5,721,783 A 2/1998 Anderson
5,784,470 A * 7/1998 Fackler ..... H04R 25/602 381/328

(Continued)

FOREIGN PATENT DOCUMENTS

EP 2 200 119 A2 6/2010
EP 2285138 A1 2/2011

(Continued)

OTHER PUBLICATIONS

Siemens AG, "RIC hearing aid receiver module with Wireless Antenna Using a Pico-coaxial Cable for Shielding," The IP.com Journal, IP.com No. IPCOM000212458D, Nov. 14, 2011, pp. 1-3 (4 pages total), XP013148018.

(Continued)

*Primary Examiner* — Curtis A Kuntz
*Assistant Examiner* — Ryan Robinson
(74) *Attorney, Agent, or Firm* — Birch, Stewart, Kolasch & Birch, LLP

(57) ABSTRACT

A hearing aid device having an antenna unit is disclosed. The hearing aid device comprises a transmission line connecting a communication unit and the antenna unit, or at least being part of a connection between them. The antenna unit is at least partly embedded in a battery drawer of the hearing aid device.

15 Claims, 3 Drawing Sheets

(52) U.S. Cl.
CPC ..... *H04R 25/652* (2013.01); *H01Q 1/44* (2013.01); *H04R 2225/025* (2013.01); *H04R 2225/51* (2013.01)

(56) References Cited

U.S. PATENT DOCUMENTS

| | | | | |
|---|---|---|---|---|
| 6,992,630 | B2 * | 1/2006 | Parsche | H01Q 1/38 343/700 MS |
| 7,443,991 | B2 * | 10/2008 | Niederdrank | H04R 25/552 381/315 |
| 7,450,078 | B2 | 11/2008 | Knudsen | |
| 7,593,538 | B2 * | 9/2009 | Polinske | H01Q 1/22 381/312 |
| 7,742,614 | B2 * | 6/2010 | Christensen | H01Q 1/273 320/108 |
| 8,125,391 | B2 * | 2/2012 | Knudsen | H01Q 1/243 343/700 MS |
| 8,401,219 | B2 | 3/2013 | Hankey | |
| 8,494,197 | B2 * | 7/2013 | Polinske | H01Q 1/243 343/866 |
| 9,609,443 | B2 * | 3/2017 | Ruaro | H04R 25/554 |
| 2007/0188402 | A1 | 8/2007 | Knudsen et al. | |
| 2009/0067649 | A1 | 3/2009 | Nikles et al. | |
| 2010/0158294 | A1 * | 6/2010 | Helgeson | H04R 25/602 381/323 |
| 2012/0087506 | A1 | 4/2012 | Özden | |
| 2013/0257676 | A1 | 10/2013 | Kerselaers et al. | |
| 2013/0328524 | A1 | 12/2013 | Bartulec et al. | |
| 2013/0342407 | A1 * | 12/2013 | Kvist | H01Q 13/10 343/718 |
| 2014/0010394 | A1 | 1/2014 | Kvist | |
| 2015/0124976 | A1 * | 5/2015 | Pedersen | H04R 25/552 381/23.1 |
| 2015/0296312 | A1 | 10/2015 | Nikles | |
| 2016/0050501 | A1 * | 2/2016 | Pinto | H01Q 1/273 381/315 |
| 2016/0165366 | A1 * | 6/2016 | So | H04R 25/65 381/315 |

FOREIGN PATENT DOCUMENTS

| | | |
|---|---|---|
| EP | 2 200 119 A3 | 6/2011 |
| EP | 2 680 366 A1 | 1/2014 |

OTHER PUBLICATIONS

Weisshaar, "Transmission Lines (Chapter 6)," Handbook of Engineering Electromagnetics, XP055415513, Sep. 1, 2004, pp. 185-186 (7 pages).

* cited by examiner

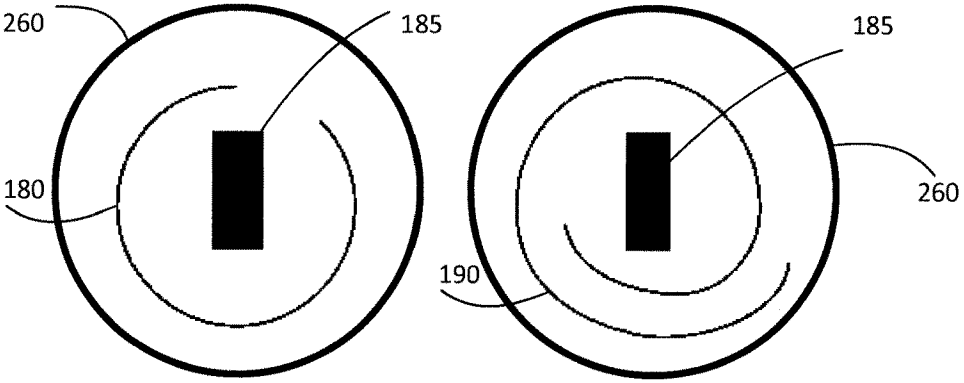
Fig. 5
Fig. 6
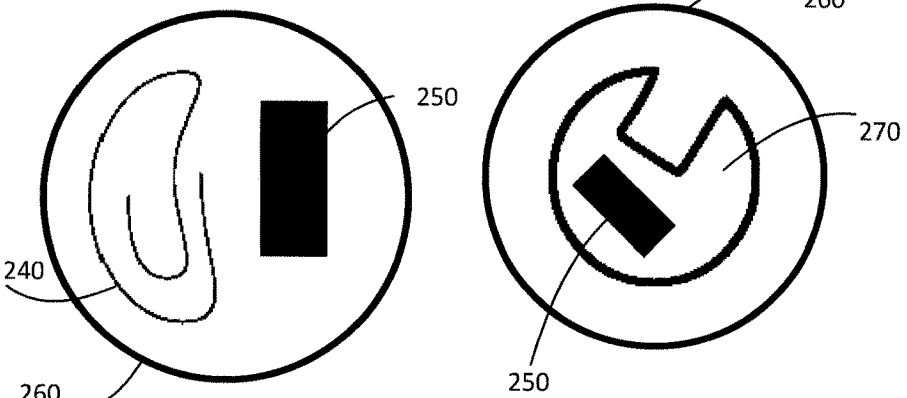
Fig. 7
Fig. 8
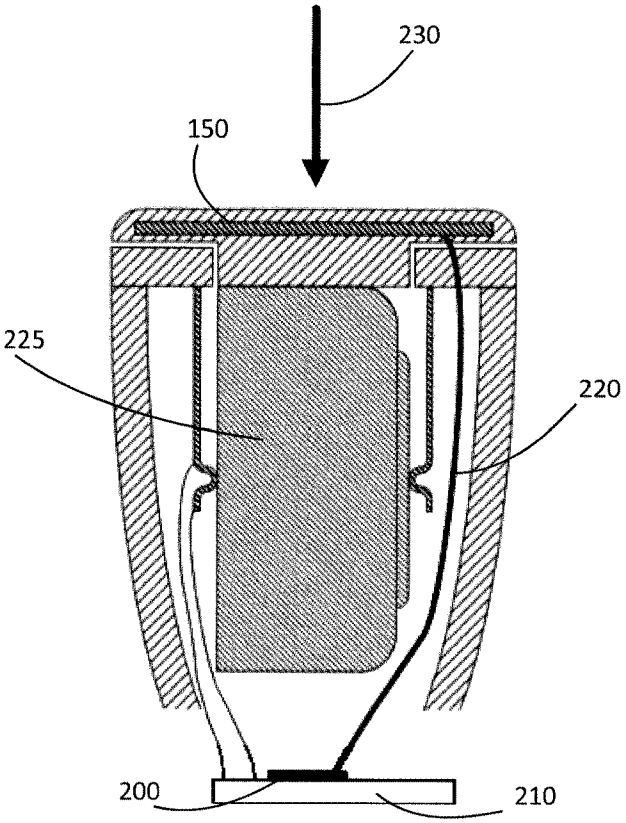
Fig. 4

HEARING DEVICE INCLUDING ANTENNA UNIT

This application is a Continuation of pending U.S. patent application Ser. No. 15/191,135, filed on Jun. 23, 2016, which claims the benefit of Patent Application No. 15173561.0 filed in Europe, on Jun. 24, 2015. The entire contents of which are hereby incorporated by reference.

FIELD

The present disclosure relates to hearing devices or other listening devices wherein wireless reception and/or transmission devices are provided.

BACKGROUND

Hearing devices for placement at least partly in the ear canal of a wearer are very dense applications and when integrating antennas in such hearing devices, there are many constraints to consider, e.g. not least coupling to other metal parts in the housing of the hearing device as such coupling will introduce loss in the signal and influence the antenna performance.

This problem is in particular present in custom style hearing devices where metallic conductors are often placed individually with a high risk of less predictable antenna performance as result.

Further, especially in ITE (in the ear) and CIC (completely in the canal) style hearing devices, it is a problem to accommodate antennas for the provision of the wireless transmission and/or reception. The ITE and CIC styles enables the wearer to have a hearing device that is as inconspicuously as possible.

Therefore, there is a need to provide a solution that addresses at least some of the above-mentioned problems. The present disclosure provides at least an alternative to the prior art.

SUMMARY

An in-the-canal hearing device has a shell or housing having an inner end to be positioned in the canal adjacent the user's eardrum and a faceplate located outwardly of the inner end but still adapted to be recessed within the ear canal when in use. A protruding portion of the shell extends outwardly past the faceplate into the concha bowl and serves the dual purpose of both anchoring the hearing device in the ear so that it cannot work its way down the ear canal, and providing a grip to facilitate insertion and removal of the hearing device. The protruding portion is preferably cut back close to the faceplate at one side of the faceplate to facilitate battery insertion and removal, and may have an aperture or a hook-like portion to facilitate gripping. A vent to vent the hearing device may extend outwardly on the protruding portion to a position adjacent the rim of the protruding portion, to space the outer vent opening away from the microphone opening on the faceplate, to reduce the likelihood of feedback.

The housing accommodates at least most or all of the electronic components of the hearing device. The housing preferably also houses a power source, such as a battery. The battery may be rechargeable or at least exchangeable. The battery may be inductively charged from an external charger unit. The battery may be stored or held in a battery drawer or the like structure. The hearing device may be adapted to improve or augment the hearing capability of a user by receiving an acoustic signal from a user's surroundings, generating a corresponding audio signal, possibly modifying the audio signal and providing the possibly modified audio signal as a signal to at least one of the user's ears, which signal the user perceives as sound.

When a hearing device intended for at least partly being placed in the ear canal of a wearer, the housing has some size restrictions that poses some difficulties when positioning for instance electronics inside the housing. One particular problem arises when there is a desire to provide wireless communication to and/or from such a hearing device at relatively high frequencies. It is well know that the head of a person will attenuate electromagnetic signals at high frequencies, e.g. around 2.4 GHz, significantly, and thus communication via an antenna in a hearing device to an external device is made difficult, especially if the external device does not have a direct line-of-sight to the hearing device antenna. Further, especially in a so-called in-the-ear hearing device all electronic components, including a battery power source, are included in the housing. Each of the electronic components are in some way connected to the battery and/or other electronic components. As each housing of the in-the-ear hearing device is custom made for each user, the elements are not located at well-defined positions relative to each other. These components and/or connectors will in some way influence the working of the antenna, there will be some coupling between the electrical signal to be transmitted or received and the components so that the components and/or connectors will exhibit a parasitic effect, which may be detrimental to the signal. Further, the parasitic effect will not be identical as a each hearing device is manufactured with a different housing configuration that previous hearing devices, meaning that the parasitic effects will be caused partially due to the individually shaped housing, but also partially to the variability of placing the components in the housing, which will contain some space not being filled with components, wiring or battery, allowing for some variation in the relative placement of the parts.

According to an aspect of the present disclosure, a hearing device comprising a housing that is configured to at least partly be positioned in the ear canal of a wearer is presented. The housing may have a first part configured for extending into the ear canal of the wearer and a second part configured to be positioned towards or at the opening of the ear canal of the wearer, such a configuration is often called an in-the-ear apparatus. The hearing device comprises elements for the processing of sound, such as an input transducer for registering ambient sound and providing an electrical signal representing the ambient sound, a sound processor for processing the electrical signal, and an output transducer to provide the processes electrical signal to the wearer, This allows for different processing, such as compensation of hearing loss, tinnitus relevant sound processing or other types of sound treatment. The hearing device may comprise an antenna unit for reception and/or emission of electromagnetic energy. The antenna unit may be positioned in the second part of the housing. The hearing device may comprise a communication unit for processing of data to be transmitted or received via the antenna unit; this may include packaging and/or unpacking data according to a communication protocol. The hearing device may comprise a transmission line connecting the communication unit and the antenna unit, or at least being part of the connection, i.e. the communication path, between them, the transmission line may be configured to transfer a signal from the communication unit to the antenna unit and/or from the antenna unit to the communication unit, so as to minimize parasitic effects on the antenna unit.

The transmission line may be terminated at a battery spring and/or battery inside the housing or a component such as an input transducer. This could provide a ground plane for the transmission line. The battery spring and/or battery and/or component may serve as part of the antenna.

The antenna unit may include a flex print and/or a lead and the antenna unit may include a part that may be arranged in a loop or a partial loop or a helix-like structure or a patch or a slot antenna or an inverted F-antenna, or a combination thereof. The actual choice of structure may depend of the size restrictions. The structure may provide desired radiation patterns. An opening or aperture may be formed in the antenna for receiving e.g. an input transducer, push-button/wheel or other component, in combination with e.g. a slot.

The antenna unit may be at least partly, or completely, embedded or in-molded in a faceplate of the housing and/or a lid of a battery drawer and/or is at least partly situated in contact with an inner surface of a faceplate of the housing. By including at least part of the antenna unit in the faceplate, i.e. the part of the housing at the end facing the ambient environment of the user. The antenna unit may comprise a flex print and/or one or more conductive wires.

The transmission line may be or include a coax cable, microstrip line, a strip line, coupled lines, a twisted line pair, a flex print or a combination thereof. These structures will further minimize the induced currents in the electrically conductive parts inside the hearing device. Further, the transmission line may be at least partly shielded or at least partly unshielded. The shielding, or partial shielding, will even still further minimize the induced currents. The shielding could be in the form of an additional element such as a wire or web arranged at at least a part of the length of the transmission line. This could e.g. be a wire or thread coiled around a length of the transmission line. The shielding could cover all of the transmission line, a major part of the transmission, a minor part of the transmission line, such as around 100% of the length of the transmission line, such as around 90%, of the length of the transmission line such as around 10% of the length of the transmission line, such as 10% to 90% of the length of the transmission line, such as around 50% of the length of the transmission line.

The housing may include an extractor cord for removing and/or inserting the hearing device in the ear canal of the wearer, and the antenna unit is at least partly disposed within the extractor cord, optionally the antenna unit is at least partly coiled within the extractor cord.

This extractor cord may be made from a resilient material allowing it to be manipulated in directions not along its length. The extractor cord is preferably not stretchable to any significant degree.

A part of the antenna unit may be disposed in the housing and optionally the part of the antenna unit disposed in the housing may be at least partly coiled inside the housing.

The antenna unit may comprise a wire, or other shaped conductor, arranged at least as part of a loop, optionally with a free end of the loop arranged in the vicinity of a power source and/or the wire being wound at least party around a power source, e.g. a single line constituting a structure similar to a monopole or rod-like member. Further, the antenna may be terminated at the distal end at a component, e.g. a microphone or other suitable component.

When providing hearing devices to a user, where the housing is to be placed in the ear canal, the housing maybe custom formed to the intended user's ear canal.

The antenna unit may be positioned between one or more electrical components inside the housing and the outer part of the second part of the housing.

The antenna unit may be configured to operate in the frequency range of 1 GHz to 10 GHz, such as 2 GHz to 2.5 GHz, such as 2400 MHz to 2483.5 MHz, such as in the frequency range of 1 GHz to 2 GHz, such as, such as 1800 MHz to 2100 MHz, such as 2100 MHz to 2200 MHz, such as 2200 MHz to 2200 MHz to 2400 MHz, such as 2400 MHz to 2500 MHz, such as 2500 MHz to 2800 MHz, such as 2800 MHz to 3000 MHz, such as around 2.4 GHz, such as around 5.1 GHz. Preferably, the antenna unit is configured to operate in the ISM-band, but other band are also possible.

In addition to the antenna unit an inductive antenna unit may be incorporated to the hearing device, e.g. to provide inductive communication to another unit positioned in close distance, such as another hearing device or an intermediate device external to the hearing device, e.g. a remote control, a mobile phone or other device configured to communicate inductively. Such an inductive antenna unit does not need to be positioned close to the opening of the ear at electromagnetic energy at e.g. around 4 MHz is not absorbed significantly in the tissue of the head.

The hearing device may be configured to communicate using the Bluetooth protocol, e.g. via having the communication unit packaging data according to a desired protocol, proprietary or according to a publically available standard.

The signal received by the antenna unit may have any kind of modulation, digital modulation, such as ASK, APSK, CPM, FSK, MFSK, MSK, 00K, PPM, PSK, QAM, SC-FDE, TCM, or analog modulation, such as AM, FM, PM, QAM, SM, SSB, or spread spectrum modulation, such as CSS, DSSS, FHSS, THSS or any other type of suitable modulation.

Advantageously, the hearing device may be a hearing aid.

In an aspect, the present disclosure relates to a hearing device aid comprising a housing configured to be positioned at least partly in the ear canal of a wearer, in which a battery drawer for accommodating a circular battery is mounted pivotally and the battery drawer being operable between a closed state and an open state. The hearing aid device may be configured to be completely or partially mounted in the ear canal of the wearer, which may be desired by the wearer as this provides a small and inconspicuous device. The battery drawer of the hearing aid device may include an embedded antenna unit. This embedded antenna unit may be coupled to a wireless interface in electrical communication with the embedded antenna. This could allow data communication between the hearing aid device and external units, such as mobile phone, auxiliary device, streaming devices such as a device configured to stream sound from a TV or the like. The data may include configuration information, such as programming, fitting, settings, programs, or the like data to the hearing aid device. This could e.g. be used when a hearing health professional is defining how the hearing aid device is to operate to assist/alleviate the wearer's specific hearing loss.

According to another aspect, when a circular battery is positioned in the battery drawer, at least a part of the embedded antenna unit is configured to follow a part of the circular battery so that a constant distance is maintained between them.

According to another aspect, the battery drawer has a part exposed to the environment and a part enclosed by the housing when the battery drawer is in the closed state, and the embedded antenna is arranged in the part of the battery drawer exposed to the environment when the battery drawer is in the closed state According to another aspect, a ratio between the width of the embedded antenna unit and the height of the circular battery is in the range of 1:1 to 1:4.

According to another aspect, the hearing aid device further comprises a balun and/or matching network between the wireless interface and the embedded antenna unit.

According to another aspect, the where holding elements are provided in the battery drawer for holding the battery on the circular circumference and wherein a part of the embedded antenna unit is included in one or more of the holding elements.

According to another aspect, the embedded antenna has a width in the range of 1/20th to 1/10th of the operational wavelength.

According to another aspect, a part of the antenna is disposed in the side of the battery drawer facing the circular battery.

According to another aspect, the operational frequency of the embedded antenna is in the range 2 to 6 GHz, such as around 2.4 GHz, such as around 5 GHz.

According to another aspect, the battery drawer includes a metallic layer, either embedded in the battery drawer or disposed in a surface there of, where the embedded antenna unit is positioned further towards the environment and the metallic layer is positioned further towards the ear canal.

According to another aspect, the embedded antenna unit is confined to the battery drawer.

According to another aspect, further comprising a transmission line connecting the communication unit and the embedded antenna unit, the transmission line configured to transfer a signal from the communication unit to the embedded antenna unit and/or from the embedded antenna unit to the communication unit, so as to minimize parasitic effects on the antenna unit, wherein at least part of the transmission line is at least partly shielded.

According to another aspect, the transmission line is terminated at a battery spring and/or battery inside the housing.

According to another aspect, the transmission line is or at least includes a coax cable, microstrip line, a strip line, coupled lines, a twisted line pair, a flex print or a combination thereof.

According to another aspect, the transmission line is a coaxial cable and the shield of the coaxial cable is terminated at the battery.

In an aspect, the present description relates to a hearing aid comprising a housing in which a battery drawer for accommodating a battery is mounted pivotally and the battery drawer having a closed state and an open state. The battery drawer may include an embedded antenna configured to follow at least a part of the circumference of the battery. The hearing aid may comprise a first and second battery terminal configured to connect to the respective positive and negative pole of the battery when the battery drawer is in a closed position. The hearing aid may comprise a wireless interface in electrical communication with the embedded antenna when the battery drawer is in the closed state. The battery may have a circular circumference, and may have two opposed flat sides. Often a battery has a one pole at a smaller bottom part and another pole at the sides and/or larger top part. The embedded antenna may have a width corresponding to the width/thickness of the battery, e.g. be equal or at least substantially equal to the width/thickness, or e.g. a percentage of the thickness, e.g. 90%, or may even be wider than the battery thickness, e.g. 110%. The embedded antenna may be shaped differently than the battery, e.g. be tapered in width, or string-like where the string-like structure is arranged either parallel to the top and/or bottom of the battery or extend in a direction from either the top or bottom towards the respective other part of the battery, e.g. in a coil-like structure or spiral-like structure.

By having at least part of the antenna unit in the battery drawer the antenna unit could be positioned beyond the surface of the face plate. Depending on the size of the battery, the antenna unit could extend beyond the faceplate in the range of 2-5 mm. The antenna unit in the battery drawer could, at least at a part of the antenna unit, have a curvature corresponding to the curvature of the battery and for at least a part of the length of the antenna unit have a lager distance to the center of the battery than the battery diameter. This increased distance could be in the range of 0.1 to 5 mm, such as around 0.5 mm, such as around 1 mm, such as around 1.5 mm. The further from the other, electrically conductive, elements the antenna unit is positioned, and/or the further out in space free of tissue, the more efficient the antenna unit will be.

The battery drawer may have a part exposed to the environment and a part enclosed by the housing when the battery drawer is in the closed state, and the embedded antenna may be located in the part of the battery drawer exposed to the environment when the battery drawer is in the closed state. A part of the embedded antenna may be in the enclosed part of the battery drawer.

It could be so that a ratio between the width of the embedded antenna and the height of the battery could be in the range of 2:1 to 1:4, such as 1:1 to 1:3.

The hearing aid could further comprise a balun between the wireless interface and the embedded antenna. This could be useful if the wireless interface has a balanced output and the antenna is unbalanced, and vice versa.

One or more holding elements could be provided in the battery drawer for holding or retaining the battery at the circular circumference and the embedded antenna could then comprise a part or section in at least one of the holding elements.

The embedded antenna could have a width in the range of 1/20th to 1/10th of the operational wavelength. The embedded antenna could be an electrically short antenna.

A part of the antenna could be disposed in the side of the battery drawer facing the battery.

Depending on the use, the operational frequency of the embedded antenna could be in the range 2 to 6 GHz, preferably around 2.4 GHz. The operational wavelength could be in the ISM band. The wireless interface could be configured to communicate using a data protocol, such as Bluetooth.

BRIEF DESCRIPTION OF DRAWINGS

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effect will be apparent from and elucidated with reference to the illustrations described hereinafter in which:

DETAILED DESCRIPTION

Figure 1:
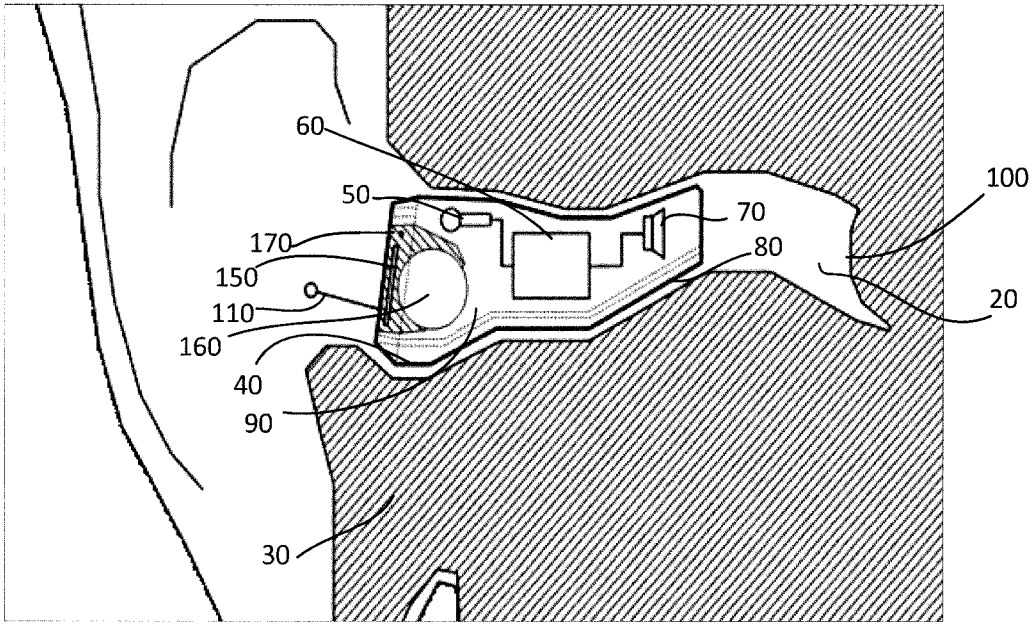
FIG. 1 schematically illustrates a cut-through view of a hearing device positioned in an ear canal of a wearer.

The detailed description set forth below in connection with the appended drawings is intended as a description of various configurations. The detailed description includes specific details for the purpose of providing a thorough understanding of various concepts. However, it will be apparent to those skilled in the art that these concepts may be practised without these specific details. Several aspects of the apparatus and methods are described by various blocks, functional units, modules, components, circuits, steps, processes, algorithms, etc. (collectively referred to as "elements"). Depending upon particular application, design constraints or other reasons, these elements may be implemented using electronic hardware, computer program, or any combination thereof.

The electronic hardware may include microprocessors, microcontrollers, digital signal processors (DSPs), field programmable gate arrays (FPGAs), programmable logic devices (PLDs), gated logic, discrete hardware circuits, and other suitable hardware configured to perform the various functionality described throughout this disclosure. Computer program shall be construed broadly to mean instructions, instruction sets, code, code segments, program code, programs, subprograms, software modules, applications, software applications, software packages, routines, subroutines, objects, executables, threads of execution, procedures, functions, etc., whether referred to as software, firmware, middleware, microcode, hardware description language, or otherwise.

A hearing device is here a hearing aid that is adapted to improve or augment the hearing capability of a user by receiving an acoustic signal from a user's surroundings, generating a corresponding audio signal, possibly modifying the audio signal and providing the possibly modified audio signal as an audible signal to at least one of the user's ears. Such audible signals may be provided in the form of an acoustic signal radiated into the user's outer ear, or an acoustic signal transferred as mechanical vibrations to the user's inner ears through bone structure of the user's head and/or through parts of middle ear of the user or electric signals transferred directly or indirectly to cochlear nerve and/or to auditory cortex of the user.

The hearing device is adapted to be worn in any known way. This may include i) arranging a unit of the hearing device behind the ear with a tube leading air-borne acoustic signals into the ear canal or with a receiver/loudspeaker arranged close to or in the ear canal such as in a Behind-the-Ear type hearing aid, and/or ii) arranging the hearing device entirely or partly in the pinna and/or in the ear canal of the user such as in a In-the-Ear type hearing aid or In-the-Canal/Completely-in-Canal type hearing aid, or iii) arranging a unit of the hearing device attached to a fixture implanted into the skull bone such as in Bone Anchored Hearing Aid or Cochlear Implant, or iv) arranging a unit of the hearing device as an entirely or partly implanted unit such as in Bone Anchored Hearing Aid or Cochlear Implant.

A "hearing system" refers to a system comprising one or two hearing devices, and a "binaural hearing system" refers to a system comprising two hearing devices where the devices are adapted to cooperatively provide audible signals to both of the user's ears. In a binaural hearing system, the hearing devices may communicate directly or indirectly to each other to cooperatively provide audible signals to both of the user's ears. The cooperation may include communication the entire sound signal from one device to the other, a part of the sound signal and/or parameters relating to the sound signal and/or settings of the hearing device. The hearing system or binaural hearing system may further include auxiliary device(s) that communicates with at least one hearing device, the auxiliary device affecting the operation of the hearing devices and/or benefitting from the functioning of the hearing devices. A wired or wireless communication link between the at least one hearing device and the auxiliary device is established that allows for exchanging information (e.g. control and status signals, possibly audio signals) between the at least one hearing device and the auxiliary device. Such auxiliary devices may include at least one of remote controls, remote microphones, audio gateway devices, mobile phones, public-address systems, car audio systems or music players or a combination thereof. The audio gateway is adapted to receive a multitude of audio signals such as from an entertainment device like a TV or a music player, a telephone apparatus like a mobile telephone or a computer, a PC. The audio gateway is further adapted to select and/or combine an appropriate one of the received audio signals (or combination of signals) for transmission to the at least one hearing device. The remote control is adapted to control functionality and operation of the at least one hearing devices. The function of the remote control may be implemented in a SmartPhone or other electronic device, the SmartPhone/electronic device possibly running an application that controls functionality of the at least one hearing device.

In general, a hearing device includes i) an input unit such as a microphone for receiving an acoustic signal from a user's surroundings and providing a corresponding input audio signal, and/or ii) a receiving unit for electronically receiving an input audio signal. The hearing device further includes a signal processing unit for processing the input audio signal and an output unit for providing an audible signal to the user in dependence on the processed audio signal. A memory device may be included in the signal processing unit for storing one or more different processing algorithms or settings so as to provide different user programs.

The input unit may include multiple input microphones, e.g. for providing direction-dependent audio signal processing. Such directional microphone system is adapted to enhance a target acoustic source among a multitude of acoustic sources in the user's environment. In one aspect, the directional system is adapted to detect (such as adaptively detect) from which direction a particular part of the microphone signal originates. This may be achieved by using conventionally known methods. The signal processing unit may include amplifier that is adapted to apply a frequency dependent gain to the input audio signal. The signal processing unit may further be adapted to provide other relevant functionality such as compression, noise reduction, etc. The output unit may include an output transducer such as a loudspeaker/receiver for providing an air-borne acoustic signal transcutaneously or percutaneously to the skull bone or a vibrator for providing a structure-borne or liquid-borne acoustic signal. In some hearing devices, the output unit may include one or more output electrodes for providing the electric signals such as in a Cochlear Implant.

FIG. 1 schematically illustrates a hearing device 10 positioned in the ear canal 20 of a wearer 30. The housing 40 of the hearing device 10 is adapted to the wearer's particular shaped ear canal by in individualisation process, the housing 40 is custom moulded to the wearer, often via an impression or based on scanning information. The hearing device 10 is intended to augment the hearing of the wearer 30 so as to improve the hearing situation of the wearer 30 by compensating for a hearing loss previously identified for that wearer, e.g. by amplification, frequency transposition, noise cancellation or other such processing.

The hearing device 10 includes an input unit 50, here a microphone, for receiving an acoustic signal from the wearer's surroundings and providing a corresponding input audio signal. The hearing device 10 further includes a signal processing unit 60 for processing the input audio signal and an output unit 70 for providing an audible signal to the wearer 30 in dependence on the processed audio signal. Here the output unit 70 is an acoustic transducer converting the processed signal to an acoustic output signal provided to the wearer's ear canal. A memory device is included in, or connected to, the signal processing unit for storing one or more different processing algorithms or processing settings so as to provide different user programs, this could for instance be a program for improving soft speech signals in quit situations and a different program for improving speech understanding in noisy environments and a further program for listening to music.

The housing 40 of the hearing device has a first part or end 80 and an opposite second part or end 90. The first part 80 is inserted into the ear canal of the wearer in the direction towards the eardrum 100. The second part 90 is formed so that it extends from the ear canal in the direction away from the ear canal. The configuration illustrated in FIG. 1 is often designated as an in-the-ear hearing device. Another configuration of the housing 40 could be the co-called completely-in-the-canal, or CIC, were the entire housing 40 is positioned in the ear canal 20, e.g. the second end 90 does not protrude beyond the opening of the ear canal.

Figure 2:
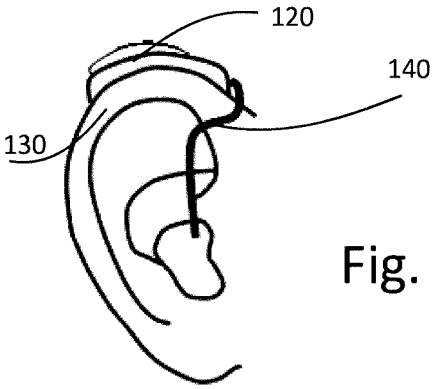
FIG. 2 schematically illustrates a hearing device having an in-the-ear part and a behind-the-ear part.

In some embodiments the in-the-ear housing 40 is connected to a behind-the-ear part 120, which is a housing generally formed so that it may be positioned behind the pinna 130 of a wearer. A connecting part 140 then connects the two parts to form the hearing device. Such a configuration is schematically illustrated in FIG. 2.

As the in-the-ear hearing device is to be inserted and extracted from the ear canal, a pull-out string 110, or extractor cord, is provided to aid the wearer in this process. The pull-out string 110 is mechanically connected to the housing 40, and the wearer may pull this string 110 when he or she wishes to remove the hearing device 10, e.g. before going to sleep. The string 110 may also assist the wearer in placing the hearing device 10 in the ear canal. Optionally an input transducer may be included in the pull-out string 110. The input transducer may then be electrically connected to the electronic components within the hearing device by one or more wires in the pull-out string. Further, the hearing device may comprise both an input transducer in the housing, e.g. at the face plate, and a second input transducer in the pull-out string. The pull-out string could be adapted to abut part of the concha at the antitragus when the hearing device is positioned in or at the ear canal. This could further help retaining the hearing device in the ear canal while the user is moving, especially if the shape of the ear canal is changing, e.g. while chewing or the like. The pull-out string could be resilient so as to better keep the hearing device in the ear canal.

An antenna unit 150 in the hearing device 10 provides an interface to transmit and/or receive electromagnetic signals. This antenna unit 150 is configured to transmit and/or receive signals in the range around 2.4 GHz, but antenna units being adapted to other operation frequencies are also possible. Other useful frequency ranges include around 5.1 GHz, or any other frequencies, especially within the ISM band(s).

The antenna unit 150 is here positioned between a battery 160 and the faceplate 170, which is the part of the housing 40 facing away from the wearer when the hearing device 10 is positioned in the ear canal 20 as intended.

In FIG. 1, the antenna unit 150 is illustrated as a flat structure parallel with the surface of the faceplate. Other arrangements are possible.

Figure 3:
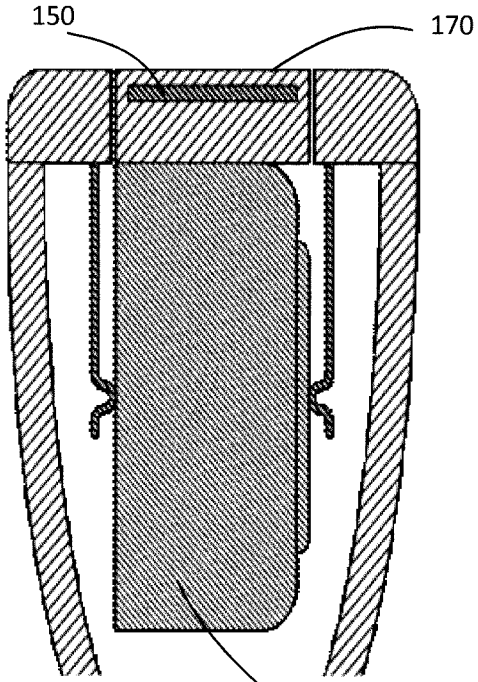
FIG. 3 schematically illustrates a partial view of a hearing device with an antenna unit, FIG. 4 schematically illustrates a partial view of a hearing device with an antenna unit, FIGS. 5-7 schematically illustrates views of antenna units and batteries arranged in different geometries, FIG. 8 schematically illustrates an antenna unit comprising a slot FIG. 9 schematically illustrates a hearing aid device having a battery drawer with an embedded antenna unit where the battery drawer is in an open state, FIG. 10 schematically illustrates a hearing aid device having a battery drawer with an embedded antenna unit, and FIG. 11 schematically illustrates a hearing aid device having a battery drawer with an embedded antenna unit seen in a side view.

FIG. 3 schematically illustrates the antenna unit 150 and battery 160 arrangement in more detail. Here the antenna unit 150 is embedded into the faceplate 170. In other embodiments, the antenna unit 150 may be positioned adjacent to the faceplate 170 without being embedded into the faceplate 170.

FIG. 4 schematically illustrates an antenna unit 150 connected to a communication unit 200 carried on a substrate 210. The substrate 210 carries other electronic components, not illustrated here, which includes for instance a sound processor, a filter, a memory unit and what else may be needed. In some instances, electronic components may be distributed on several substrates, but for simplicity only one substrate is illustrated. These components are connected to other parts via a number of conductive leads, here illustrated by the line 240 and 250. Especially for the leads connecting to the output transducer and/or input transducer, these conductive leads may include weights to minimize mechanical transfer of energy, which could lead to the so-called feedback effect when operating the hearing device. The weights are intended to change the frequency response of the leads. The weights may be constructed from a metallic or a non-metallic material.

A transmission line 220 connects the antenna unit 150 and the communication unit 200. Here the transmission line ground is terminated to the ground plane of the communication unit. Furthermore, or alternatively, the transmission line ground might be terminated to one of the battery springs. The communication unit 200 is connected to the transmission line 220 via a matching circuit, not illustrated. When using a radio unit, i.e. communication unit, having a balanced output, the communication unit 200 may further be connected to the transmission line via a balun if needed. This means that the communication unit is connected to a matching circuit, which in turn is connected to the transmission line, which is connected to the antenna unit.

The transmission line 220 transfers the signal intended to be transmitted from the communication unit 200 via the antenna unit 150 to a device located remote from the hearing device 10. The transmission line 220 also transfers signals received by the antenna unit 150 to the communication unit 200. Appropriate filter(s) and/or balun and/or matching circuit may be provided when needed.

In FIGS. 5-8 a face place is schematically illustrated as the circle 260, it is recognised that the actual shape will not be circular as the face plate will at least partly be positioned at or near the concha, probably as the part extending from the ear canal.

The antenna unit 150 may, in some configurations, include a conductive lead or trace that surrounds the battery 160. This is schematically illustrated in FIGS. 5 and 6, which is viewed in the direction of the arrow 230. In FIG. 5, a lead 180 is partly looped or coiled around a battery 185. This allows using the battery 185 as a ground plane for the antenna unit, preferably by capacitive coupling between the metal in the battery 185 and the lead 180, alternatively by galvanic connecting the antenna unit 150 and the battery 185 surface. In FIG. 6 a lead 190 is coiled or wound more than one turn around the battery 185. The lead 190 may be fed at either end of the lead 190, alternatively at any point along the lead 190, similar apply to the lead 180 in FIG. 5. If the lead in addition to being wound or coiled around the battery is also spaced along the battery the lead could be said to have a helix-like geometry.

In yet other configurations, when viewed at the second part towards the first part, i.e. as would be seen by another person looking at the wearer's ear when the hearing device was mounted, further in the direction illustrated by the arrow 230, the antenna unit may take up part of the surface and other components may take up the remaining part of the surface, this is schematically illustrated in FIG. 7 where an antenna unit 240 and a component 250 are shown next to each other. Such components 250 could be volume adjustment wheel, extractor cord, on/off switch, programming interface or other suitable components. Seen from this direction, a battery may also take up a major part of the surface.

A plate or planer structure may be included so as to form a sort of parasitic antenna element, which is contemplated to increase the directionality of the antenna system.

Figure 10:
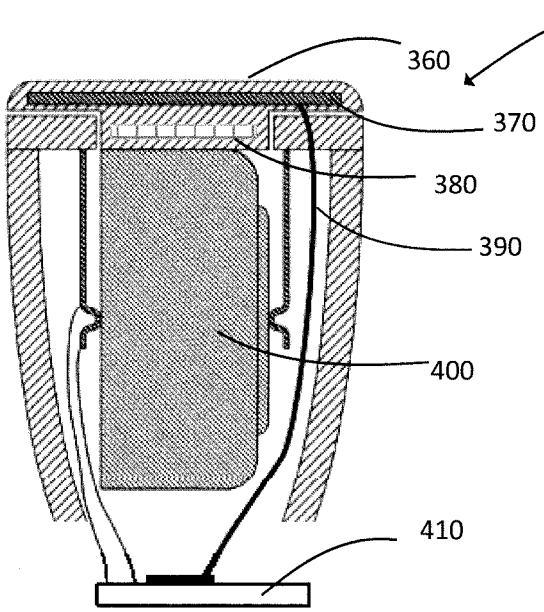

In another configuration, an additional layer may be provided, such as illustrated in FIG. 10. Here a conductive layer is formed at a distance from the surface of the faceplate of the in-the-ear hearing aid. Here the conductive layer is embedded in the faceplate, the conductive layer may be formed on the inner surface of the faceplate, i.e. the part facing towards the inner of the hearing aid. The conductive layer is arranged so that it acts as at least part of the ground plane for the antenna. The conductive layer may be arranged at a greater distance from the faceplate, e.g. below/beyond the battery, e.g. so that the battery and the conductive layer together forms a ground for the antenna unit. In both configurations the conductive layer may act as a shield, in particular an RF shield, between the antenna unit and the printed circuit board carrying electronic components, such as sound processor etc., and also wires in the hearing aid, e.g. wires connecting the battery to the printed circuit board, the wires connecting the input transducer to the printed circuit board, but possibly also the wires connecting the printed circuit board with the output transducer in the remote end of the hearing aid. The RF shield will lessen the coupling between antenna and wires and hence also the impact of the coupling.

The conductive layer may include an opening configured to receive the battery.

The conductive layer could be trimmed to fit the faceplate as a part of the manufacturing process for producing hearing aids with a shape suiting the individual wearer.

By utilising the transmission line 220, the feed point is established at a well-defined position relative to the antenna unit 150, whereas when using a regular conductive wire between the communication unit 200 and the antenna unit 150 the wire would be subject to a wide range of electromagnetic coupling to e.g. the wires carrying a signal from the input transducer and/or to the output transducer. By terminating the transmission line 220 near the antenna unit 150, e.g. as illustrated in FIG. 4 at a battery spring near the antenna unit 150, the feed point is well-established, especially in situations where the substrate 210 carrying the radio 200 is not, e.g., fixated to a side of the housing 40 of the hearing device or is allowed to float freely in the space between the battery and the housing.

Also, the battery may have unwanted influences on the signal carried to/from the communication unit and the antenna unit 150. Thus, this will minimise the influence of any metal parts in the hearing device and provide a controlled impedance for the antenna unit. In various embodiments the transmission line 220 may be constituted by coax cable, coupled lines or twisted pairs. Further, the transmission line 220 may be shielded or unshielded. The transmission line 220 is intended to minimise any interaction of the signal with the surrounding components, and therefore it would be advantageous that the transmission line 220 is shielded. The shielding could be achieved by a thread or string of conductive wire twirled or twisted around the transmission line 220.

When using a coaxial cable, it is possible to terminate the coaxial cable at the desired frequency to the battery spring and/or the battery itself. The termination could e.g. be a connection from the outer conductor of the coaxial cable to an element such as the battery. This will further minimise the variation in antenna efficiency and/or performance introduced by the uncontrolled/unknown positions of the litz wires inside the custom-build hosing.

FIG. 8 is a schematic illustration of a hearing device having a faceplate 260, the hearing device includes a slot antenna structure 270. The slot antenna 270 is positioned near the surface of the face plate. The slot antenna 270 could be embedded into the face place, as is also the case with the other illustrated antenna units. Alternatively the antenna unit could be placed directly below, or adjacent to, the face place, e.g. in the space illustrated in FIG. 4 as just below the face plate and above the battery 225. In FIG. 8 a battery 250 is positioned in the conducting part of the plate, so that the battery 220 will have a minimal effect on the antenna unit 270. Other components may be placed in a similar fashion, or in the slot itself.

The battery 250 should be accessible for replacement. Alternatively, the battery 220 may be rechargeable. Further alternatively the battery 220 may be inductively charged.

Figure 9:
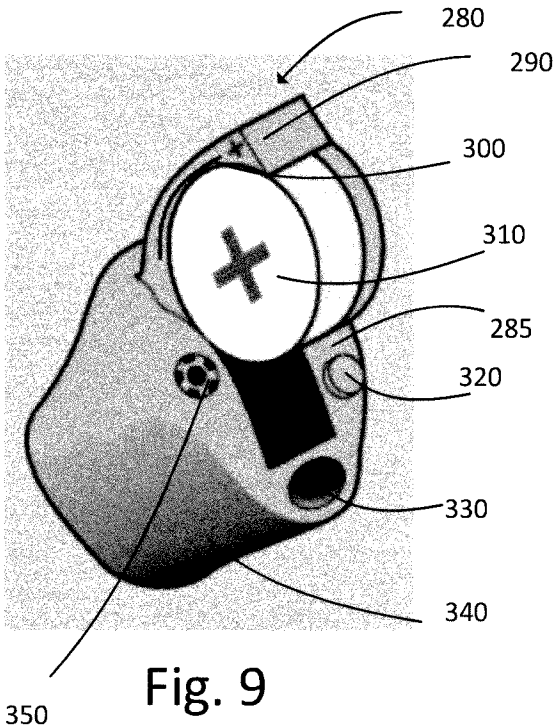

FIG. 9 schematically illustrates a hearing aid device 280. The hearing aid device 280, or the housing 340 thereof, is configured to be positioned in the ear canal of a user or wearer during use. The hearing aid device 280 has a battery drawer 290. Here the battery drawer 290 is illustrated in an open state. The battery drawer 390 includes an embedded antenna unit 300. The embedded antenna unit 300 is located in the part of the battery drawer 290 facing towards the environment when the hearing aid device 280 is positioned in the ear canal of the wearer. Here, the width if the embedded antenna unit 300 approximates the width of the battery drawer. Other widths of the embedded antenna unit may be envisioned. In the faceplate 285 of the hearing aid device 280 other components may be desired, here is illustrated a microphone inlet 350, a button 320 and a vent hole 330. The housing 340 may be custom fit to the particular user, or have a shape that fits a range of people's ear canals. The embedded antenna unit 300, at least a part there of, may conform to the shape of the battery. Here the embedded antenna unit 30 conforms to the shape of the battery drawer 290, which again, at least partly, conform to the shape of the battery. The embedded antenna unit 300 may have a substantially constant distance to the battery, at least for a part of the length of the antenna unit.

FIG. 10 schematically illustrates a hearing aid device 355 having a battery drawer, here a battery 400 is stored in the battery drawer 360, and the battery drawer is illustrated in a closed state. The battery drawer 360 includes an embedded antenna unit 370. Here it is illustrated that a conductive layer 380, i.e. the additional layer discussed above, is positioned between the battery 400 and the embedded antenna unit 370. Here the conductive layer 380 is narrower than the embedded antenna unit 370. The thickness of the conductive layer 380 compared to the embedded antenna unit 370 could be different or similar. Advantageously at least for a part of the length, e.g. seen along the direction along the surface of the side of the battery 400 along which the embedded antenna unit 370 extends, the distance between the embedded antenna unit 370 and the layer, and between the embedded antenna unit 370 and the battery 400 may be substantially constant.

Figure 11:
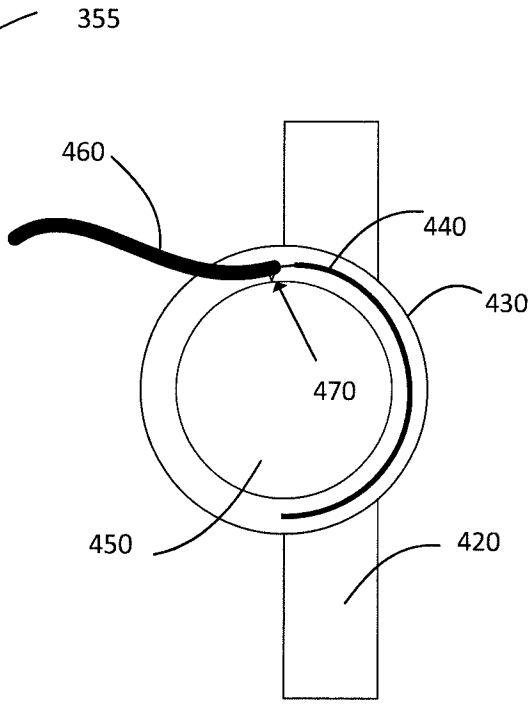

FIG. 11 schematically illustrates a part of a hearing aid device having a battery drawer 430 with an embedded antenna unit 440 seen in a side view. The battery drawer 430 extends from a faceplate 420. A transmission line 460 operatively connects the embedded antenna unit 440 with wireless interface, not illustrated here. The transmission line 460 is terminated 470 to the battery 450. The embedded antenna unit 430 and the battery 450 are arranged with a constant distance between them. As in the hearing aid device 355 of FIG. 10, the hearing aid device in FIG. 11 may include an additional layer between the embedded antenna unit 440 and the battery 450.

In the illustration the substrate is connected to a battery spring with two lines, these lines are merely intended to illustrate the concept of connecting a battery supply to electronics on the substrate. The electronic components may be distributed on several substrates and/or several substrates may be joined to form a common substrate. Two or more components, e.g. a processor and memory, could be placed on a dedicated substrate, which in turn is then connected to a main substrate. Components may be embedded into the substrate or substrates.

When terminating the transmission line to e.g. the battery or a battery spring, suitable components may be connected as well, e.g. for protection of various components.

The different antenna structures may be combined with or include any of the features mentioned throughout the present specification.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element but an intervening elements may also be present, unless expressly stated otherwise. Furthermore, "connected" or "coupled" as used herein may include wirelessly connected or coupled. As used herein, the term "and/or" includes any and all combinations of one or more of the associated listed items. The steps of any disclosed method is not limited to the exact order stated herein, unless expressly stated otherwise.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

The invention claimed is:

1. A hearing aid device comprising a housing configured to be positioned at least partly in the ear canal of a wearer, in which a battery drawer for accommodating a circular battery is mounted pivotally and the battery drawer being operable between a closed state and an open state, wherein the housing includes a faceplate arranged to face towards the environment, the hearing aid device comprises an antenna unit, a part of the antenna unit being partly embedded in the battery drawer, wherein the part of the antenna unit in the battery drawer has a curvature corresponding to the curvature of the battery, wherein, when a circular battery is positioned in the battery drawer, at least a part of the embedded antenna unit is configured to follow a part of the circular battery where a constant distance is maintained between them, and the hearing aid device further comprises a wireless interface in electrical communication with the antenna unit.

2. The hearing aid device according to claim 1, wherein the hearing aid device further comprises a battery spring and an electronic component mounted on a substrate located in the hearing aid housing, and the battery spring and/or battery and/or electronic component mounted on the substrate located in the hearing aid housing is a part of the antenna unit.

3. The hearing aid device according to claim 1, wherein the battery drawer has a part exposed to the environment and a part enclosed by the housing when the battery drawer is in the closed state, and the embedded antenna is arranged in the part of the battery drawer exposed to the environment when the battery drawer is in the closed state.

4. The hearing aid device according to claim 1, wherein a ratio between the width of the embedded antenna unit and the height of the circular battery is in the range of 1:1 to 1:4.

5. The hearing aid device according to claim 1, wherein the hearing aid device further comprises a balun and/or matching network between the wireless interface and the embedded antenna unit.

6. The hearing aid device according to claim 1, wherein the where holding elements are provided in the battery drawer for holding the battery on the circular circumference and wherein a part of the embedded antenna unit is included in one or more of the holding elements.

7. The hearing aid device according to claim 1, wherein the embedded antenna has a width in the range of $1/20^{th}$ to $1/10^{th}$ of the operational wavelength.

8. The hearing aid according to claim 1 wherein a part of the antenna is disposed in the side of the battery drawer facing the circular battery.

9. The hearing aid device according to claim 1, wherein the operational frequency of the embedded antenna is in the range 2 to 6 GHz, such as around 2.4 GHz, such as around 5 GHz.

10. The hearing aid device according to claim 1, wherein the battery drawer includes a metallic layer, either embedded in the battery drawer or disposed in a surface there of, where the embedded antenna unit is positioned further towards the environment and the metallic layer is positioned further towards the ear canal.

11. The hearing aid device according to claim 1, further comprising a transmission line connecting the communication unit and the embedded antenna unit, the transmission line configured to transfer a signal from the communication unit to the embedded antenna unit and/or from the embedded antenna unit to the communication unit, so as to minimize parasitic effects on the antenna unit, wherein at least part of the transmission line is at least partly shielded.

12. The hearing aid device according to claim 11, wherein the transmission line is terminated at a battery spring and/or battery inside the housing.

13. The hearing aid device according to claim 11, wherein the transmission line is or at least includes a coax cable, microstrip line, a strip line, coupled lines, a twisted line pair, a flex print or a combination thereof.

14. The hearing aid device according to claim 13, wherein the transmission line is a coaxial cable and the shield of the coaxial cable is terminated at the battery.

15. The hearing aid device according to claim 1, wherein the hearing aid device further comprises an inductive unit configured to provide inductive communication to an external device.

* * * * *